United States Patent [19]

Fukuda et al.

[11] 4,315,063

[45] Feb. 9, 1982

[54] ELECTROPHOTOGRAPHIC PHOTOSENSITIVE MEMBER HAVING A HALOGEN CONTAINING CHARGE INJECTION LAYER

[75] Inventors: Tadaji Fukuda; Teruo Misumi, both of Toride, Japan

[73] Assignee: Canon Kabushiki Kaisha, Tokyo, Japan

[21] Appl. No.: 959,005

[22] Filed: Nov. 9, 1978

[30] Foreign Application Priority Data

Nov. 17, 1977 [JP] Japan ..... 52-138204

[51] Int. Cl.[3] ..... G03G 5/10; G03G 5/14

[52] U.S. Cl. ..... 430/65; 430/67; 430/60; 430/64; 430/84

[58] Field of Search ..... 96/1.5 R, 1 PC; 252/501; 430/67, 95, 60, 57, 65

[56] References Cited

U.S. PATENT DOCUMENTS

| | | | |
|---|---|---|---|
| 3,335,003 | 8/1967 | Snelling | 96/1.5 |
| 3,355,289 | 11/1967 | Hall et al. | 430/67 X |
| 3,467,548 | 9/1969 | Straughan | 96/1.5 |
| 3,501,343 | 3/1970 | Regensburger | 96/1.5 |
| 3,635,705 | 1/1972 | Ciuttini | 430/57 |
| 3,639,120 | 2/1972 | Snelling | 430/95 |
| 3,769,010 | 10/1973 | Hanada et al. | 430/67 X |
| 4,001,014 | 1/1977 | Ando et al. | 96/1.5 |
| 4,046,565 | 9/1977 | Miller | 96/1.5 |
| 4,123,269 | 10/1978 | VonHoene et al. | 96/1.5 N |
| 4,202,937 | 5/1980 | Fukuda et al. | 430/58 |

FOREIGN PATENT DOCUMENTS 49-2629 1/1974 Japan .

OTHER PUBLICATIONS

Journal of Non-Crystalline Solids 4 1970, pp. 80–96.

*Primary Examiner*—John D. Welsh
*Assistant Examiner*—John L. Goodrow
*Attorney, Agent, or Firm*—Fitzpatrick, Cella, Harper & Scinto

[57] ABSTRACT

An electrophotographic photosensitive member comprising an electric charge injection layer, an amorphous photoconductive layer on said charge injection layer, and an insulating layer on said amorphous photoconductive layer, said charge injection layer containing halogen as an impurity.

8 Claims, 7 Drawing Figures

ELECTROPHOTOGRAPHIC PHOTOSENSITIVE MEMBER HAVING A HALOGEN CONTAINING CHARGE INJECTION LAYER

BACKGROUND OF THE INVENTION

1. Field of the Invention

This invention relates to an electrophotographic photosensitive member, and, more particularly, it is concerned with an electrophotographic photosensitive member which is less likely to fatigue after repeated use at a high speed.

2. Description of the Prior Art

For an electrophotographic photosensitive member, many embodiments have been employed in accordance with the specific electrophotographic process to be applied. Of these various electrophotographic photosensitive members, there is one having an insulating layer on its surface which forms an electrostatic latent image on the insulating layer. An electric charge is required to be injected in the interface between the insulating layer and the photoconductive layer by electric charging. As one example of such electrophotographic process, there is a process comprising a primary charging, image exposure, AC charge removal simultaneously with or subsequent to, the image exposure, or alternatively electric charging in the opposite polarity to that of the primary charging, and then whole surface exposure. When the photoconductive layer is made of a p-type semiconductor such as Se, SeTe, etc., the primary charging is conducted by a negative corona discharge to inject a positive charge from the supporting body, or substrate, into the photoconductive layer, and the electric charge is caused to migrate to the interface between the insulating layer and the photoconductive layer in accordance with the electric field applied to the photoconductive layer. When it is difficult to inject the charge from the substrate, uniform light irradiation is effected onto the photosensitive member immediately before, or simultaneously with, the negative corona discharge, whereby an appropriate quantity of the positive charge can be provided to the interface between the insulating layer and the photoconductive layer. when this light irradiation is conducted from the side of the substrate, the substrate should be made of a light transmitting material such as, for example, nesa glass, light transmitting resin film, and so on. When the photoconductive layer is constructed with an n-type semiconductor, the charge polarity in the primary charging is positive, and the charge migrating to the interface between the insulating layer and the photoconductive layer is negative. At the initial charging, the injection of an appropriate quantity of electric charge between the insulating layer and the photoconductive layer is indispensable for producing an electrostatic latent image of high contrast. For this purpose, when the electrically conductive substrate is made of, for example, a metal material, a charge injection layer is provided between the substrate and the photoconductive layer as disclosed in Japanese Patent Publication No. 49-6223 (corresponding to British Patent Specification No. 1,335,699). This charge injection layer supplies sufficient electric charge to the photoconductive layer at the time of the charging, and thereby contributes to the presence of an appropriate quantity of charge between the insulating layer and the photoconductive layer. Even by addition of the charge injection layer, however, there still exists room for improvement. That is, when the photosensitive member is repeatedly used and, in particular, when its cycle of repeated use is accelerated, the charge quantity present in the interface between the insulating layer and the photoconductive layer is gradually reduced. As a result it is often observed that the electric potential at the dark portion of the electrostatic latent image after repeated operations, approaches the potential of the bright portion thereof in comparison with its initial level, and the image contrast is lowered. This has been explained as the so-called "fatigue phenomenon" of the photosensitive member.

SUMMARY OF THE INVENTION

It is a primary object of the present invention to provide a photosensitive member which does not show fatigue phenomenon even after repeated use at high speed.

It is another object of the present invention to provide a photosensitive member capable of forming a clear image of high contrast.

It is still another object of the present invention to provide a photosensitive member effective for a high speed electrophotographic process.

According to the present invention, there is provided an electrophotographic photosensitive member comprising an electric charge injection layer, an amorphous photoconductive layer on the charge injection layer, and an insulating layer on the amorphous photoconductive layer, the charge injection layer containing halogen as an impurity.

The intended object of the present invention can be achieved by including halogen as the impurity into the charge injection layer. The charge injection layer of the present invention possesses a much higher free charge density than a conventional layer by employing halogen as the impurity, whereby it can function as an effective charge injecting source capable of injecting sufficient quantity of electric charge into the photoconductive layer.

DESCRIPTION OF THE PREFERRED EMBODIMENTS

Figure 1:
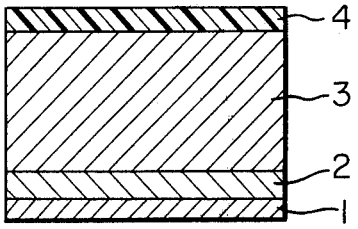
FIGS. 1 and 2 indicate preferred embodiments of the electrophotographic photosensitive member according to the present invention.
Figure 2:
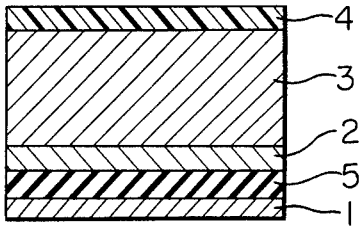

The most representative structure of the electrophotosensitive member according to the present invention is illustrated in FIGS. 1 and 2. The photosensitive member shown in FIG. 1 comprises a substrate 1, a charge injection layer 2, a photoconductive layer 3, and an insulating layer 4. The insulating layer is transmissive to light (radiant rays) which the photoconductive layer sensitizes. The substrate may be either electrically conductive or insulative. For the electrically conductive substrate, there can be enumerated various metal materials such as aluminum (Al), nickel (Ni), brass, copper (Cu), silver (Ag), and so on, and electrically conductive glass. For the insulative substrate, there may be exemplified resins such as polyester, polyethylene, etc., as well as paper, glass, ceramics, and others. The photoconductive layer is made of the various amorphous semiconductors which have so far been used as the photoconductive materials for electrophotography. For such amorphous semiconductive materials, there may be enumerated the Se series semiconductor, such as Se, SeTe, SeAs, SeSb, SeBi, SeTeAs, etc., and such a semiconductor to which other elements such as sulfur (S), phosphorus (P), germanium (Ge), etc. are added. The insulating layer is ordinarily made of a resin material. The resin materials for use as the insulating layer may be, for example, polyester, polyparaxylylene, polyurethane, polycarbonate, polystyrene, etc.

The charge injection layer as used in the present invention is a layer that does not form an electrical barrier between the charge injection layer and a layer to be joined former layer, or one that forms a substantially negligible electrical barrier as the name indicates, this layer is to provide electric charge necessary for causing an adequate quantity of electrical charge to be present in the interface between the photoconductive layer and the insulating layer at the time of charging.

The charge injection layer in the present invention consists of a semiconductive layer containing therein halogen as an impurity, the free charge density of which is far greater than that of the photoconductive layer. While the material for forming the charge injection layer may be appropriately selected in accordance with a kind of material forming the photoconductive layer and the electrophotographic characteristic required of the photosensitive member, the material is generally selected by considering the following points: (1) when the layer to be joined to the charge injection layer is constructed with a p-type semiconductor, the work function of the charge injection layer should be equal to, or greater than, that of the material used for the layer to be joined. and (2) when the layer to be joined is constructed with an n-type semiconductor, the work function of the charge injection layer should be equal to, or smaller than, that of the layer to be joined; and (3) sufficient free charge can be excited employing heat energy at about room temperature (dark resistance is low).

Representative materials for forming the charge injection layer are a: chalcogen element (Se, Te and S, or a mixture of these elements), or semiconductors with the chalcogen elements as the principal constituent such as SeAs, SeBi, SeSb, etc., and halogen. When the amorphous photoconductive layer is to be formed with a p-type semiconductor of the Se series such as, for example, Se, SeTe, SeAs, etc., the charge injection layer should be made either of a material like Te having a large work function, or of a material the, same as that constituting the amorphous photoconductive layer, and containing therein halogen as the impurity.

The charge injection layer can be formed by various methods. For instance, it may be formed by evaporative deposition of a semiconductive material containing therein halogen, or by simultaneous deposition of the semiconductive material and halogen (simultaneous evaporative deposition). Alternatively, it may be formed by fusing and coating a semiconductive material containing therein halogen. The semiconductive material containing halogen may be prepared by either directly mixing the semiconductive material and a simple substance containing halogen, or by mixing various halogenated compounds (such as, for example, $SeX_2$, $SeX_4$ where X is F, Cl, Br, or I) with the semiconductive material. As one example, the semiconductive material and a single substance containing halogen (particularly, in the case of Br or I), or a halogenated compound (e.g., $SeCl_4$) are so mixed that halogen is contained in the semiconductive material at a desired concentration. Then the mixture is placed in an ampule of pyrex glass under vacuum seal. The ampule is heat-treated for four hours or so at a temperature of 500° C. During the heat-treatment, the ampule is subjected to vibration either occasionally or continuously so as to sufficiently stir the molten material uniformly and to prevent halogen from segregating. After the heat-treatment, the ampule is quenched in cooling water to thereby provide the semiconductive material containing therein halogen as the impurity.

In the present invention, halogen is present in the charge injection layer as a impurity in the form other than its compound, in other words, in a form doped into the semiconductive material.

The content of halogen in the charge injection layer according to the present invention, in its lower limit, is usually about 10 ppm or above (% by weight), more preferably 100 ppm or above, and optimumly 500 ppm or above. The upper limit of the halogen content, on the other hand, may be properly determined in accordance with characteristics so desired. However, when the halogen quantity is too large, the degree of vacuum in the evaporative deposition chamber is inevitably lowered at time of the evaporative deposition hence, the content should desirably be 10,000 ppm or below.

The film thickness of the charge injection layer may be appropriately determined in accordance with the characteristics of the layer as desired. More definitively, within a range not to impair the primary characteristics of the charge injection layer for the purpose of the present invention, the lower limit of the film thickness is determined such that the film may be applied completely onto the substrate surface regardless of unevenness of such surface. The upper limit thereof may be determined in consideration of the desired flexibility of the photosensitive member. Usually, a range of from 0.5 to 15 microns, or preferably from 1 to 10 microns is recommended.

The thickness of the photoconductive layer may be appropriately determined by taking into account the relationship between the electrophotographic characteristics desired and the abovementioned charge injection layer desired. Usually, a range of from 5 to 100 microns, preferably from 10 to 80 microns, or optimumly from 25 to 75 microns is advisable. For the photoconductive layer, an Se-type photoconductive layer, i.e., a layer made of Se or of a material with Se as the principal constituent is particularly preferable.

The photosensitive member shown in FIG. 2 is the same structure as that shown in FIG. 1 with the exception that an additional insulating layer 5 is interposed between the substrate 1 and the charge injection layer 2. For the additional insulating layer 5, there may be used any appropriate insulative material such as, for example, polyester, polyparaxylylene, and various other resins as well as metal oxides, glass, and so forth.

A representative example of the electrophotographic process, in which the photosensitive member according to the present invention can be effectively utilized is one which injects electric charge from the side of the substrate at the time of charging and causes the same to migrate toward the interface between the insulating layer and the photoconductive layer. A concrete example of such an electrophotographic system is disclosed in Japanese Patent Publications No. 42-23910, No. 43-24748, No. 42-19748, No. 44-13437, No. 49-44902, and others, wherein an electrostatic latent image is formed by a sequence of primary charging, secondary charging in opposite polarity to that of the primary charging, or AC charge removal and simultaneous image exposure, and whole surface exposure. In the above-described electrophotographic system, the image exposure may be carried out either before or after the secondary charging or AC charge removal. The whole surface exposure may be dispensed with.

Referring to FIGS. 3 to 7 inclusive and several examples, further details will be given as to effectiveness of the charge injection layer according to the present invention.

REFERENCE EXAMPLE 1

Figure 3:
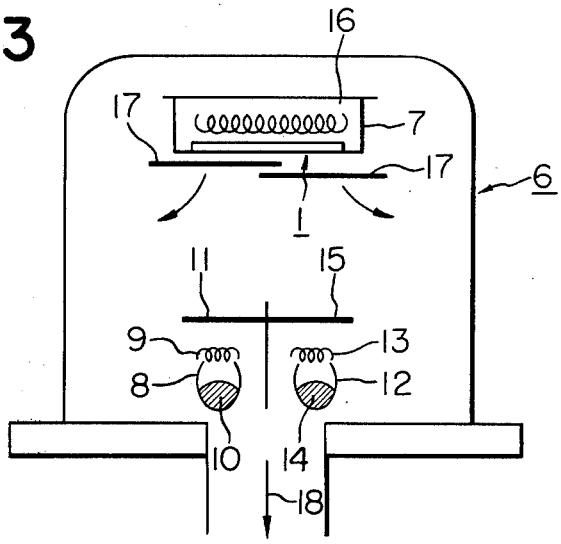
FIG. 3 shows one embodiment of an evaporative deposition chamber for use in the production of the electrophotographic photosensitive member according to the present invention.

As shown in FIG. 3, an aluminum base plate 1 of 50×100 mm is placed at a predetermined position in an evaporative deposition chamber 6. The base plate, or substrate 1 is fixed to a fixing member 7 with it being separated by 10 mm or so from a heater 16 for heating the substrate.

Subsequently, 55 gr. of Se powder with 99.999% purity is filled in an evaporating boat or vessel 8 made of quartz. Separate from this, 5 gr. of Se powder of 99.999% purity which had been previously doped with 2,000 ppm of chlorine (Cl) was filled in an evaporating boat 12 made of quartz. Over the evaporating boats 8 and 12, there are provided tungsten spiral heaters 9 and 13, respectively. Then, air within the evaporating chamber 6 was discharged in the direction of an arrow 18 to evacuate the chamber 6 to a degree of vacuum of approximately $5\times10^{-5}$ torr. Preparation being thus completed, the heater 16 is ignited to raise the temperature of the substrate 1 to 60° C. The substrate is kept at this temperature level.

In the following, horological changes in the substrate temperature and the deposition speed during the evaporative deposition will be explained by reference to FIG. 4.

The spiral heater 13 over the evaporating boat 12 is actuated to raise the temperature of the boat to 300° C., thereby melting the chlorine-containing Se in the evaporating boat 12.

Figure 4:
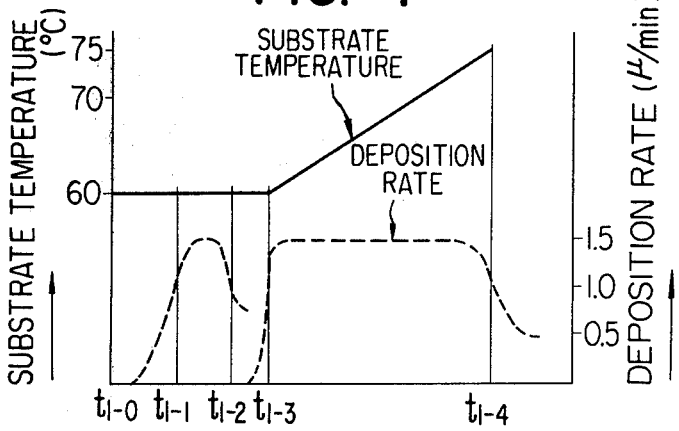
FIGS. 4 and 6 are graphical representations showing preferred examples of depositing conditions for the production of the electrophotographic photosensitive member according to the present invention.

As shown in FIG. 4, a shutter 15 and a right-half of a shutter 17 are opened at a time instant $t_{1-1}$ when the chlorine-containing Se has become uniformly melted so that the evaporative deposition may be commenced onto the right-half of the substrate 1 in FIG. 3. This is continued until the chlorine-containing Se in the evaporating boat 12 will become exhausted (formation of the charge injection layer) (layer 19 in FIG. 5). Then, the shutter 15 is closed at a time instant $t_{1-2}$ when the chlorine-containing Se in the evaporating boat 12 is completely used up. Subsequently, the spiral heater 9 over the evaporating boat 8 is ignited to raise the temperature of the evaporating boat 8 to 300° C. in the same manner as mentioned above, thereby melting Se. At a point $t_{1-3}$ when Se is uniformly melted in the evaporating boat 8, a shutter 11 is opened and the shutter 17 is fully opened to start the evaporative deposition of Se over the entire surface of the substrate. At the same time, current flowing through the heater 16 is regulated to gradually raise the substrate temperature as shown in FIG. 4 so that its temperature may be 75° C. or so at the termination of the evaporative deposition. At a point $t_{1-4}$ when Se in the evaporating boat 8 is almost exhausted, current flowing through the spiral heater 9 is discontinued, and the shutter 11 is closed to terminate the evaporative deposition of Se (layer 20 in FIG. 5).

Figure 5:
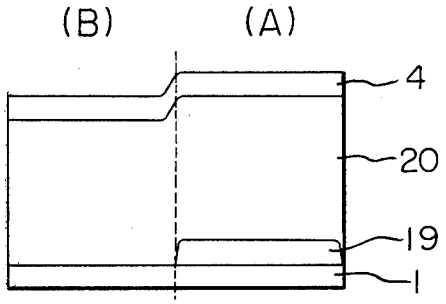
FIG. 5 is a diagrammatic cross-section showing a structure of the electrophotographic photosensitive member according to the present invention.

The thickness of the deposited film was found to be 60 microns at its right half (A) and 55 microns at its left half (B) (vide FIG. 5). The deposition rate of Se to the substrate 1 was approximately 1.5 microns/min. The substrate 1 with the deposited layer formed thereon was taken outside of the deposition chamber 6, and polycarbonate resin was applied on the deposited surface to a thickness of 25 microns to form the insulating layer 4. Thus, the photosensitive plate was prepared. The cross-section of thus prepared photosensitive plate is shown in FIG. 5.

The thus prepared photosensitive plate was subjected to corona discharge of ⊖6,000 volts as the primary charging operation for 0.2 sec. to thereby charge its surface with ⊖2,000 v. Subsequently, positive corona discharge of ⊕6,000 v. at the source voltage was carried out for 0.2 sec. as the secondary charging operation to remove electric charge from the surface of the insulating layer, followed by uniform overall irradiation on the surface of the photosensitive plate. As the result, the right side (A) showed a surface potential of ⊖900 v., while the left side (B) showed ⊖800 v. When this process was repeated within a cycle of 2 sec., the surface potential after the overall irradiation became gradually reduced at the left side (B), and after 100 repetitions, it was found to be ⊖640 v. On the other hand, the surface potential at the right side (A) remained unchanged, i.e., ⊖900 v. even after 100 repeated operations.

REFERENCE EXAMPLE 2

Figure 6:
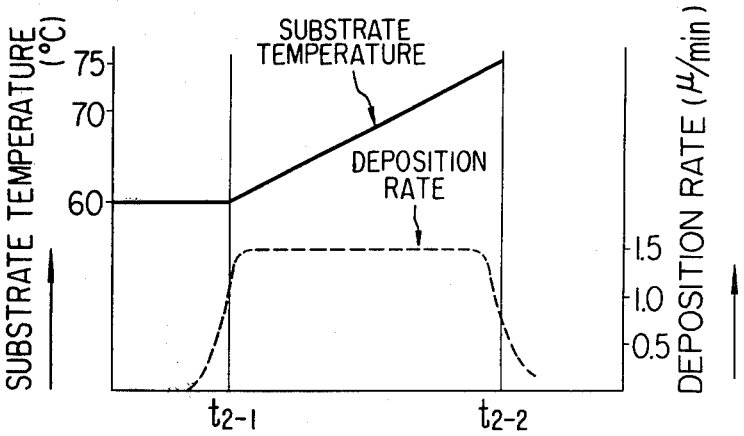

The evaporating boat 8 in the deposition chamber 6 as shown in FIG. 3 was taken away from it, after which 60 gr. of Se powder of 99.999% purity which was previously doped with 2,000 ppm of chlorine was filled in the evaporating boat 12. Then, in the same procedures as in the foregoing Reference Example 1, Se was evaporatively deposited on the aluminum substrate to thereby form a deposited layer of 60 microns thick. The relationship between the substrate temperature and the depositing speed with lapse of time during this evaporating operation is shown in FIG. 6. In the graphical representation, a point $t_{2-1}$ shows opening of the shutter 15, and a point $t_{2-2}$ denotes closing thereof. Incidentally, the shutter 17 was kept open during the evaporative deposition operation.

The substrate, on which the film was deposited, was taken out of the depositing chamber 6, and a positive corona discharge of ⊕5,500 v. at the source voltage was conducted in the dark for 0.3 sec. on the surface of the deposited film. Immediately after this corona discharge, the surface potential was measured. It showed ⊕150 v. On the other hand, the insulative layer of polycarbonate resin on the photosensitive plate in Reference Example 1 was removed by dissolving it in methylene chloride, and then the surface thereof was charged under the same condition as above, followed by immediate measurement of its surface potential. The result showed that both sides (A) and (B) were at ⊕1,200 v.

From the above, it was found out that the dark resistance of the photosensitive plate coated with the chlorine-containing Se (Reference Example 2) is much smaller than the dark resistance of the photosensitive plate coated with Se (Reference Example 1). In other words, the photosensitive plate coated with chlorine-containing Se has a very large free charge density in comparison with the photosensitive plate coated with Se, which means that the electrical capacity of the photosensitive plate is very large.

In the Reference Example 1, the reason for the difference with respect to the repeated fatigue in both portions (A) and (B) of the photosensitive plate has not yet been clarified. It may, however, be assumed it follows from the phenomenon in the Reference Example 2, to wit:

The layer at the side (A) of the photosensitive plate in the Reference Example 1 evaporatively deposited with chlorine-containing Se (the charge injection layer) has a very high free charge density as set forth Reference Example 2. In contrast to this, the Se deposited layer is low in its free charge density. It is therefore considered that place an abrupt change takes place in the free charge density at the interface of the layer evaporatively deposited with the chlorine-containing Se and the layer coated with Se.

On the other hand, it is considered that, at the side (B) of the photosensitive plate, there exist on the substrate surface many nuclei sufficient to cause crystallization of the Se-deposited film owing to contamination of the substrate, adsorption of molecules onto the surface, and the like. On account of this, the Se-deposited film in the vicinity of the interface between the film and the substrate is apt to readily crystallize. This tendency is reduced as the evaporative deposition proceeds (i.e., as the film thickness increases), in proportion to which the free charge density becomes low.

Figure 7:
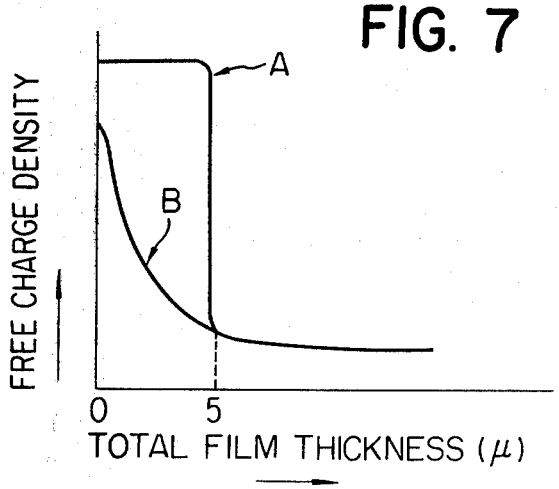
FIG. 7 is a graphical representation showing a relationship between the free charge density and the film thickness in a conventional electrophotographic photosensitive member as compared to that according to the present invention.

In summary, changes in the free charge density at both sides (A) and (B) with respect to the direction of the film thickness from the substrate is considered to be as shown in FIG. 7.

As at the side (B) of the photosensitive plate, when the free charge density is gradually varied, there tends to be formed a positive spatial charge in the Se photoconductive layer in the vicinity of the substrate. Therefore, it is considered that, with an increase in the number of times of repeated use, the charge to be injected into the photoconductive layer is reduced at the time of the primary charging, thus causing fatigue due to repetitive use.

EXAMPLE 1

An aluminum substrate of 50×100 mm was fixed within the evaporative deposition chamber 6 shown in FIG. 3 with it being kept separated by 10 mm or so from the heater 16. Subsequently, 55 gr. of Se powder having 99.999% purity was filled in the evaporating boat 8 made of quartz. Separately, 5 gr. of Se powder of 99.999% purity which was previously doped with 4,000 ppm of chlorine was filled in the evaporating boat 12 of quartz. Tungsten spiral heaters 9 and 10 were provided over the respective evaporating boats 8 and 12. Then, the interior of the deposition chamber 6 was evacuated to a degree of vacuum of $5\times10^{-5}$ torr. The heater 16 was ignited to raise the temperature of the aluminum base plate to 60° C., and the substrate was maintained at this temperature. On the other hand, the spiral heater 13 over the evaporating boat 12 was ignited to raise the temperature of the evaporating boat 12 to 300° C. to melt chlorine-containing Se. When the chlorine-containing Se was uniformly molten, the shutters 15 and 17 were fully opened, and the evaporative deposition of Se was conducted until the chlorine-containing Se was exhausted in the evaporating boat 12. As soon as the chlorine-containing Se was used up in the boat 12, the shutter 15 was closed, and the current flowing through the spiral heater 13 was discontinued (formation of the charge injection layer). Thereafter, the spiral heater 9 over the evaporating boat 8 was ignited, and the temperature of the evaporating boat 8 was raised to 300° C. in the same manner as mentioned above to thereby melt Se powder in the boat. As soon as the Se powder was uniformly molten, the shutter 11 was opened, and the evaporative deposition was commenced. At the same time, the substrate temperature was gradually raised by regulating current flowing through the heater 16 so that its temperature may be 75° C. at the termination of the evaporative deposition. When Se in the evaporating boat 8 is almost exhausted, current flowing through the spiral heater 9 is interrupted, and the shutter 11 is closed to terminate the evaporative deposition (formation of the photoconductive layer). Thereafter, the vacuum condition was broken and the evaporatively deposited substrate was taken out of the deposition chamber 6, and then polycarbonate resin was coated on the surface of the evaporatively deposited film to a thickness of 25 microns to form an insulative layer, thereby obtaining the photosensitive member. The thickness of the evaporatively deposited layer was 60 microns. The depositing speed of the film onto the substrate was 1.5 microns/-min. or so.

The thus prepared photosensitive member was subjected to primary electric charging by carrying out corona discharge of ⊖6000 v. for 0.2 sec. to charge its surface to ⊖2000 v., then to secondary charging by carying out the positive corona discharge of ⊕6000 v. at the power source voltage for 0.2 sec. to uniformly remove the charge from the surface of the insulating layer. Subsequently, when the whole surface irradiation was done uniformly, the surface potential showed ⊖900 v.

The above-described process was repeatedly carried out with a 2-second cycle, and the surface potential after the 100th whole surface irradiation was measured. It remained the same as the initial surface potential value of ⊖900 v., and no fatigue phenomenon could be found at all.

EXAMPLE 2

One side surface of an aluminum substrate of 50×100 mm in size was subjected to alumite treatment of 10 microns thick by anode oxidation. Then, the aluminum substrate was fixed in the evaporating chamber 6 shown in FIG. 3 with the alumite-treated surface being faced to the evaporating boat and with the substrate being kept separated from the heater 16 by 10 mm or so. The evaporative deposition was conducted under the identical conditions as in Example 1 above. After the deposition, the insulating layer was formed with polycarbonate resin to obtain the photosensitive member.

The thus prepared photosensitive member was subjected to the negative corona discharge of ⊖6000 v. for 0.2 sec. as the primary charging to thereby charge the surface with ⊖2000 v. Thereafter it was subjected to the negative corona discharge of ⊖6000 v. for 0.2 sec. as the secondary charging to thereby remove the charge on the surface of the insulating layer. Subsequently, when the overall surface of the photosensitive body was uniformly irradiated, the surface potential thereof showed ⊕800 v.

The above-described process was repeatedly carried out with 2-second cycle, and the surface potential value after the 100th overall surface irradiation was measured. It remained same as the initial value of ⊖800 v., and no fatigue phenomenon could be recognized.

EXAMPLE 3

An aluminum substrate of 50×100 mm was fixed in the evaporative deposition chamber 6 shown in FIG. 6 with it being kept apart from the heater 16 by about 10 mm. Next, 55 gr. of SeTe alloy powder (10 wt% of Te content) of 99.999% purity was filled in the evaporating boat or vessel 8 of quartz, and, at the same time, SeTe alloy powder (10 wt% of Te content) of 99.999% purity which was previously doped with 1000 ppm of chlorine was filled in a separate evaporating boat 12 of quartz. The tungsten spiral heaters 9 and 10 were respectively provided over the evaporating boats 8 and 12. Then, the deposition chamber 6 was evacuated to a degree of vacuum of $5\times10^{-5}$ torr. Next, the heater 16 was ignited to raise the temperature of the aluminum substrate to 60° C., and the substrate was kept at this temperature. Then, the spiral heater 13 over the evaporating boat 12 was ignited to raise the temperature of the evaporating boat 12 to 320° C. to thereby melt SeTe containing chlorine. When the chlorine-containing SeTe was uniformly melted, the shutters 15 and 17 were fully opened, and the evaporative deposition onto the aluminum substrate was continued until the chlorine-containing SeTe in the evaporating boat 12 was almost used up. At a point where the chlorine-containing SeTe was exhausted in the evaporating boat 12, the shutter 15 was closed and the current flowing through the spiral heater 13 was discontinued (formation of the charge injection layer). Thereafter, the spiral heater 9 over the evaporating boat 8 was ignited to raise the temperature of the evaporating boat 8 to 320° C. same as mentioned above, thereby melting the SeTe alloy powder. When the SeTe alloy powder was uniformly melted, the shutter 11 was opened and the evaporative deposition was commenced. At the same time, the substrate temperature was gradually raised by regulating the current flowing through the heater 16 so that the temperature may become 75° C. or so at the termination of the evaporation. Upon substantial consumption of the SeTe alloy in the evaporating boat 8, current flowing through the spiral heater 9 was discontinued, and the shutter 11 was closed to terminate the evaporation (formation of the photoconductive layer). Thereafter, the vacuum condition was broken and the evaporatively deposited substrate was taken out of the deposition chamber 6. Subsequently, polycarbonate resin was coated on the surface of the evaporatively deposited film to a thickness of 25 microns to form the insulating layer. Thus, the photosensitive member was prepared. The thickness of the evaporatively deposited layer was 60 microns. The deposition rate of the evaporatively deposited film was 1.5 microns/min. or so.

The thus prepared photosensitive member was used under the same charging conditions, charging time, and repeating cycle as in Example 1 above. The surface potential after the 100th whole surface was ⊖800 v. which was not different from the measured value in the first whole surface irradiation, and the fatigue phenomenon could not be seen.

EXAMPLE 4

An aluminum substrate of 50×100 mm in size was fixedly placed in the deposition chamber 6 shown in FIG. 3 with it being kept separated by 10 mm or so from the heater 16. Next, 55 gr. of Se powder of 99.999% purity was filled in the evaporating boat 8 made of quartz. Separately, 5 gr. of Se powder of 99.999% purity which was previously doped with 1000 pm of SeI was filled in the evaporating boat 12. Tungsten spiral heaters 9 and 10 were respectively provided over the evaporating boats 8 and 12, and the deposition chamber 6 was evacuated to a degree of vacuum of $5\times10^{-5}$ torr. Next, the heater 16 was ignited to raise the temperature of the aluminum substrate to 60° C., and the substrate was kept at the temperature. Then, the spiral heater 13 over the evaporating boat 12 was ignited, and the temperature of the boat 12 was raised to 300° C. to melt Se containing I. When the iodine-containing Se was uniformly melted, the shutters 15 and 17 were fully opened, and the evaporative deposition was continuously done onto the aluminum substrate until the iodine-containing Se became exhausted in the evaporating boat 12. At the time when the iodine-containing Se was exhausted in the evaporating boat 12, the shutter 15 was closed, and the current flowing through the spiral heater 13 was discontinued (formation of charge injection layer).

Thereafter, the spiral heater 9 on the evaporating boat 8 was ignited, and the temperature of the boat 8 was raised to 300° C. in the same manner as mentioned above to thereby melt the Se powder in it. When the Se powder was uniformly molten, the shutter 11 was opened to commence the evaporative deposition. At the same time, the substrate temperature was gradually raised by regulating the current flow through the heater 16 so that the temperature thereof might become 75° C. or so at the termination of the evaporation. Upon substantial consumption of Se in the evaporating boat 8, current flowing through the spiral heater 9 was discontinued, and the shutter 11 was closed to terminate the evaporative deposition (formation of the photoconductive layer). After this, the vacuum condition was broken and the evaporatively deposited substrate was taken out of the deposition chamber 6. Then, on the surface of this evaporatively deposited film, polycarbonate resin was coated to a thickness of 25 microns to form the insulating layer. Thus, the photosensitive plate was prepared. The thickness of the evaporatively deposited layer was 60 microns. The depositing rate of the evaporated coating onto the substrate was 1.5 microns/min.

When the thus prepared photosensitive plate was repeatedly used under the conditions same as Example 1 above, the surface potential after the first whole surface irradiation was ⊖900 v., while the value after 100 times of the whole surface irradiation remained unchanged, so that no fatigue phenomenon could be recognized.

EXAMPLE 5

An aluminum substrate of 50×100 mm in size was fixedly placed in the deposition chamber 6 shown in FIG. 3 with it being kept separated from the heater 16 by 10 mm or so. 55 gr. of Se powder of 99.999% purity was filled in the evaporating boat 8 of quartz. Separately, SeTe alloy powder of 99.999% purity (15 wt% of Te content) which was previously doped with 2000 ppm of chlorine was filled in the evaporating boat 12 of quartz. The tungsten spiral heaters 9 and 10 were respectively provided over the evaporating boats 8 and 12, and the interior of the deposition chamber 6 was evacuated to a degree of vacuum of $5\times10^{-5}$ torr. Subsequently, the heater 16 was ignited to raise the temperature of the aluminum substrate to 60° C., and the substrate was kept at this temperature. The spiral heater 13 over the evaporating boat 12 was ignited and the temperature of the evaporating boat 12 was raised to 340° C. to melt SeTe containing chlorine. When the chlorine-containing SeTe was uniformly molten, the shutters 15 and 17 were fully opened, and the evaporative deposition was continued onto the aluminum substrate until the chlorine-containing SeTe in the evaporating boat 12 was consumed. When the chlorine-containing SeTe was used up in the evaporating boat 12, the shutter 15 was closed, and the current flowing through the shutter 13 was discontinued (formation of the charge injection layer). Thereafter, the spiral heater 9 over the evaporating boat 8 was ignited, and the temperature of the boat 8 was raised to 300° C. same as mentioned above, thereby melting Se powder therein. When the Se powder was uniformly molten, the shutter 11 was opened and the evaporative deposition was commenced. At the same time, the substrate temperature was gradually raised by regulating the current flowing through the heater 16 so that its temperature may become 75° C. at the termination of the evaporative deposition. Upon substantial exhaustion of Se in the evaporating boat 8, current flowing through the spiral heater 9 was discontinued, and the shutter 11 was closed to terminate the evaporative deposition (formation of the photoconductive layer). Thereafter, the vacuum condition was broken, and the evaporatively deposited substrate was taken out of the deposition chamber 6, followed by coating of polycarbonate resin of the surface of the evaporatively deposited film to a thickness of 25 microns to form the insulating layer. Thus, the photosensitive plate was prepared. The film thickness of the evaporatively deposited layer was 60 microns, and the depositing speed of the evaporatively deposited film onto the substrate was 1.5 microns/min.

The thus prepared photosensitive plate was repeatedly used under the same condition as in Example 1. The surface potential after the first whole surface irradiation was ⊖830 v., and the value after 100 times of the whole surface irradiation remained unchanged, hence no fatigue phenomenon could be recognized at all.

EXAMPLE 6

Each of the photosensitive members prepared in accordance with Examples 1 through 5 was subjected to repeated process of the primary charging, the secondary DC discharge in opposite polarity to that of the primary charging simultaneously with image exposure, and the whole surface irradiation, thereby forming an image. A favorable image faithful to the original could be formed.

What we claim is:

1. An electrophotographic photosensitive member comprising an electric charge injection layer from 1 to 10 microns in thickness, an amorphous photoconductive layer from 25 to 75 microns in thickness on said charge injection layer, and an insulating layer on said amorphous photoconductive layer, said charge injection layer being a semiconductive layer containing halogen as an impurity; wherein when the layer to be joined to the charge injection layer employs a p-type semiconductor, the work function of the charge injection layer should be equal to or greater than that of the material used for the layer to be joined; and when the layer to be joined to the charge injection layer employs an n-type semiconductor, the work function of the charge injection layer should be equal to or smaller than, that of the layer to be joined.

2. The electrophotographic photosensitive member as set forth in claim 1, wherein the content of halogen in said charge injection layer ranges from 10 ppm to 10,000 ppm.

3. The electrophotographic photosensitive member as set forth in claim 1, wherein said charge injection layer is composed of a chalcogen element and a halogen, or a semiconductor with a chalcogen element as the principal constituent and a halogen.

4. The electrophotographic photosensitive member as set forth in claim 1, further comprising an additional insulating layer, said charge injection layer being formed on the insulating layer.

5. The electrophotographic photosensitive member as set forth in claim 1, further comprising a substrate supporting said electric charge injection layer.

6. An electrophotographic photosensitive member comprising an electric charge injection layer from 1 to 10 microns in thickness, an amorphous photoconductive layer from 25 to 75 microns in thickness on said charge injection layer, and an insulating layer on said amorphous photoconductive layer, said charge injection layer being a semiconductive layer containing halogen as an impurity; wherein when the layer to be joined to the charge injection layer employs a p-type semiconductor, the work function of the charge injection layer should be equal to or greater than that of the material used for the layer to be joined; and when the layer to be joined to the charge injection layer employs an n-type semiconductor, the work function of the charge injection layer should be equal to or smaller than, that of the layer to be joined; and said amorphous photoconductive layer being of the selenium series.

7. The electrophotographic photosensitive member as set forth in claim 6, wherein said charge injection layer is composed of a selenium series semiconductor and halogen contained as the impurity in the selenium series semiconductor.

8. The electrophotographic photosensitive member as set forth in claim 6, further comprising a substrate supporting said electric charge injection layer.

* * * * *

UNITED STATES PATENT AND TRADEMARK OFFICE

CERTIFICATE OF CORRECTION

PATENT NO. : 4,315,063

DATED : February 9, 1982

INVENTOR(S) : FUKUDA, ET AL.

It is certified that error appears in the above—identified patent and that said Letters Patent is hereby corrected as shown below:

Col. 1, line 44, "when" should read --When--.
Col. 3, line 27, after "joined" insert --to the--.

Col. 3, line 55, "are a:" should read --are: a--.
Col. 3, line 63, "material the," should read --material, the--.

Col. 7, line 27, after "that" delete --place--.
Col. 8, line 42, "carying" should read --carrying--.
Col. 9, line 8, " ⊕ " should read -- ⊖ --.

Signed and Sealed this

*Twenty-fourth* Day of *August 1982*

[SEAL]

*Attest:*

GERALD J. MOSSINGHOFF

*Attesting Officer*

*Commissioner of Patents and Trademarks*